US010976036B2

(12) United States Patent
Fryzek

(10) Patent No.: US 10,976,036 B2
(45) Date of Patent: Apr. 13, 2021

(54) ROTATABLE LINEAR DOWNLIGHT

(71) Applicant: ABL IP Holding LLC, Atlanta, GA (US)

(72) Inventor: Aaron P. Fryzek, Wheaton, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/808,675

(22) Filed: Mar. 4, 2020

(65) Prior Publication Data

US 2020/0284413 A1 Sep. 10, 2020

Related U.S. Application Data

(60) Provisional application No. 62/813,980, filed on Mar. 5, 2019.

(51) Int. Cl.
*F21V 21/26* (2006.01)
*F21V 21/30* (2006.01)
(Continued)

(52) U.S. Cl.
CPC ..... *F21V 21/30* (2013.01); *F21S 8/026* (2013.01); *F21V 7/0066* (2013.01); *F21V 21/04* (2013.01);
(Continued)

(58) Field of Classification Search
CPC ..... F21V 21/30; F21V 21/26; F21V 21/34; F21W 2131/304; F21S 8/028; F21Y 2103/00
See application file for complete search history.

(56) References Cited

U.S. PATENT DOCUMENTS 5,145,249 A 9/1992 Bruckner
5,285,356 A 2/1994 Skene et al.
(Continued)

FOREIGN PATENT DOCUMENTS

CN 300828658 9/2008
CN 302643183 11/2013
(Continued)

OTHER PUBLICATIONS

"Go Ocean Downlights LED Recessed Downlight Adjustable 50W 85-265V Down Light LED Downlights Ceiling Lamp Down Lights", Online Available At: https://www.aliexpress.com/item/32379831833.html, Accessed from internet on Apr. 29, 2020, 2 pages.
(Continued)

*Primary Examiner* — William J Carter
*Assistant Examiner* — Omar Rojas Cadima
(74) *Attorney, Agent, or Firm* — Kilpatrick Townsend & Stockton LLP

(57) ABSTRACT

A luminaire includes a frame defining an opening, the frame having first and second frame edges on opposite sides of the opening. The luminaire also includes a carriage disposed within the opening, the carriage having a front face and first and second carriage edges on opposite sides of the front face, and one or more light sources arranged on the carriage. The luminaire further includes a tilting mechanism arranged such that the carriage is tiltable in at least two directions within the opening, and wherein when the carriage is tilted in a first direction from the central position, the first carriage edge remains proximate the first frame edge; and when the carriage is tilted in a second direction from the central position, the second carriage edge remains proximate the second frame edge.

17 Claims, 12 Drawing Sheets

(51) Int. Cl.

| | |
|---|---|
| ***F21S 8/02*** | (2006.01) |
| ***F21V 7/00*** | (2006.01) |
| ***F21V 21/04*** | (2006.01) |
| *F21Y 115/10* | (2016.01) |
| *F21V 29/70* | (2015.01) |
| *F21Y 103/10* | (2016.01) |

(52) U.S. Cl.
CPC ..... *F21V 29/70* (2015.01); *F21Y 2103/10* (2016.08); *F21Y 2115/10* (2016.08)

(56) References Cited

U.S. PATENT DOCUMENTS

| | | | | |
|---|---|---|---|---|
| D346,872 | S | 5/1994 | Gecchelin | |
| D365,159 | S | 12/1995 | Tinen | |
| 5,564,815 | A | 10/1996 | Littman et al. | |
| 5,803,585 | A | 9/1998 | Littman et al. | |
| D411,031 | S | 6/1999 | Conn et al. | |
| D437,074 | S | 1/2001 | Johnson | |
| 6,629,771 | B2 | 10/2003 | Chiu | |
| 6,755,557 | B2 | 6/2004 | Stauner et al. | |
| 6,779,908 | B1 | 8/2004 | Ng | |
| D542,963 | S | 5/2007 | Zucker | |
| D548,387 | S | 8/2007 | Mcdowell | |
| D568,517 | S | 5/2008 | Redfern et al. | |
| D570,538 | S | 6/2008 | Chan et al. | |
| D578,237 | S | 10/2008 | Engel | |
| D578,692 | S | 10/2008 | Engel | |
| 7,465,070 | B2 | 12/2008 | Engel | |
| 7,478,931 | B2 | 1/2009 | Miletich et al. | |
| D607,143 | S | 12/2009 | Sugishita et al. | |
| 7,744,253 | B2 | 6/2010 | Engel | |
| D627,913 | S | 11/2010 | Gielen | |
| 7,832,889 | B1 | 11/2010 | Cogliano | |
| 7,857,492 | B2 * | 12/2010 | Dixon | F21S 8/02 362/428 |
| D633,241 | S | 2/2011 | Piano | |
| D633,242 | S | 2/2011 | Piano | |
| D638,974 | S | 5/2011 | Fuksas | |
| D639,486 | S | 6/2011 | Wauters | |
| D639,981 | S | 6/2011 | Guzzini | |
| 7,967,480 | B2 | 6/2011 | Pickard et al. | |
| 7,972,035 | B2 | 7/2011 | Boyer | |
| D645,183 | S | 9/2011 | Cucinella | |
| D647,416 | S | 10/2011 | Kim et al. | |
| 8,038,321 | B1 | 10/2011 | Franck et al. | |
| 8,038,327 | B1 | 10/2011 | Franck et al. | |
| D647,811 | S | 11/2011 | Kim et al. | |
| D648,240 | S | 11/2011 | Kim et al. | |
| D648,644 | S | 11/2011 | Kim et al. | |
| D648,867 | S | 11/2011 | Guzzini | |
| D653,792 | S | 2/2012 | Spiro | |
| D664,697 | S | 7/2012 | Piano | |
| 8,215,805 | B2 | 7/2012 | Cogliano et al. | |
| 8,313,212 | B1 | 11/2012 | Mayer et al. | |
| D673,067 | S | 12/2012 | Kim et al. | |
| 8,456,109 | B1 | 6/2013 | Wray | |
| 8,469,536 | B2 | 6/2013 | Cogliano et al. | |
| 8,525,432 | B2 | 9/2013 | Wray | |
| 8,534,864 | B2 | 9/2013 | Forteza et al. | |
| D690,875 | S | 10/2013 | Mckenzie et al. | |
| 8,581,520 | B1 | 11/2013 | Wray | |
| D698,970 | S | 2/2014 | Guzzini | |
| D698,971 | S | 2/2014 | Guzzini | |
| D698,972 | S | 2/2014 | Guzzini | |
| D699,385 | S | 2/2014 | Guzzini | |
| D701,345 | S | 3/2014 | Ghini | |
| 8,684,570 | B1 | 4/2014 | Fuchs | |
| D707,872 | S | 6/2014 | Piano | |
| 8,742,695 | B2 | 6/2014 | Wray | |
| 8,827,490 | B2 | 9/2014 | Kim et al. | |
| D715,482 | S | 10/2014 | Kuo | |
| 8,858,028 | B2 | 10/2014 | Kim | |
| D717,487 | S | 11/2014 | Guzzini | |
| 8,944,637 | B2 | 2/2015 | Spiro | |
| 9,010,968 | B2 | 4/2015 | Gattari | |
| D731,688 | S | 6/2015 | Piano | |
| 9,144,131 | B2 | 9/2015 | Wray | |
| 9,157,609 | B2 | 10/2015 | Littman Gatof et al. | |
| D745,204 | S | 12/2015 | Skira | |
| D745,207 | S | 12/2015 | Guzzini | |
| D746,503 | S | 12/2015 | Skira | |
| D747,025 | S | 1/2016 | Skira | |
| D747,531 | S | 1/2016 | Skira | |
| 9,301,359 | B2 | 3/2016 | Wray | |
| D754,905 | S | 4/2016 | Colombo | |
| 9,404,643 | B2 | 8/2016 | Clark | |
| D767,812 | S | 9/2016 | Skira | |
| D768,326 | S | 10/2016 | Guzzini | |
| D768,327 | S | 10/2016 | Guzzini | |
| D768,903 | S | 10/2016 | Guzzini | |
| D773,109 | S | 11/2016 | Hu | |
| 9,494,294 | B2 | 11/2016 | Edmond et al. | |
| D778,482 | S | 2/2017 | Guzzini | |
| D778,483 | S | 2/2017 | Guzzini | |
| D778,484 | S | 2/2017 | Guzzini | |
| 9,599,295 | B2 | 3/2017 | Delano | |
| D784,583 | S | 4/2017 | Philips | |
| D784,584 | S | 4/2017 | Philips | |
| D784,585 | S | 4/2017 | Philips | |
| D784,587 | S | 4/2017 | Piano | |
| D784,588 | S | 4/2017 | Piano | |
| D785,227 | S | 4/2017 | Guzzini | |
| D785,228 | S | 4/2017 | Guzzini | |
| D787,730 | S | 5/2017 | Gines | |
| D788,344 | S | 5/2017 | Gecchelin | |
| 9,638,380 | B2 | 5/2017 | Kramer et al. | |
| D788,968 | S | 6/2017 | Salomon | |
| D789,586 | S | 6/2017 | Guzzini | |
| D790,102 | S | 6/2017 | Guzzini | |
| D790,107 | S | 6/2017 | Wilmotte | |
| 9,671,091 | B2 | 6/2017 | Jones | |
| 9,689,565 | B2 | 6/2017 | Fryzek | |
| 9,726,354 | B1 | 8/2017 | Delano et al. | |
| D800,940 | S | 10/2017 | Guzzini | |
| D805,676 | S | 12/2017 | Piano | |
| 9,851,081 | B2 | 12/2017 | Clark | |
| D807,558 | S | 1/2018 | Guzzini | |
| D814,670 | S | 4/2018 | Delano et al. | |
| 10,024,523 | B2 | 7/2018 | Delano | |
| D826,444 | S | 8/2018 | Van Berkel et al. | |
| D827,171 | S | 8/2018 | Van Berkel et al. | |
| D835,321 | S | 12/2018 | Delano et al. | |
| 10,247,390 | B1 | 4/2019 | Kopitzke, IV | |
| D853,009 | S | 7/2019 | Coirier | |
| D853,010 | S | 7/2019 | Coirier | |
| D853,011 | S | 7/2019 | Coirier | |
| D854,216 | S | 7/2019 | Coirier | |
| D854,217 | S | 7/2019 | Coirier | |
| D854,219 | S | 7/2019 | Coirier | |
| 10,359,162 | B2 | 7/2019 | Terumichi | |
| 10,415,803 | B2 | 9/2019 | Spiro | |
| D869,727 | S | 12/2019 | Gruendl et al. | |
| D869,728 | S | 12/2019 | Gruendl et al. | |
| D869,729 | S | 12/2019 | Gruendl et al. | |
| 2008/0304269 | A1 | 12/2008 | Pickard et al. | |
| 2010/0110698 | A1 | 5/2010 | Harwood et al. | |
| 2010/0165616 | A1 * | 7/2010 | Wilkinson | F21V 21/30 362/231 |
| 2011/0051410 | A1 | 3/2011 | Liang | |
| 2011/0103062 | A1 | 5/2011 | Park et al. | |
| 2014/0185302 | A1 | 7/2014 | Ebisawa | |
| 2014/0204574 | A1 | 7/2014 | Ebisawa | |
| 2016/0135268 | A1 | 5/2016 | Pearson et al. | |
| 2018/0073705 | A1 * | 3/2018 | Delano | F21V 7/00 |
| 2019/0128509 | A1 | 5/2019 | Kramer et al. | |

FOREIGN PATENT DOCUMENTS

| | | |
|---|---|---|
| CN | 303241199 | 6/2015 |
| DE | 4111578 | 10/1992 |
| DE | 202017106749 | 11/2017 |
| EM | 000089313-0002 | 3/2004 |
| EM | 000238548-0003 | 3/2005 |

(56) References Cited

FOREIGN PATENT DOCUMENTS

| | | |
|---|---|---|
| EM | 000279195-0013 | 3/2005 |
| EM | 000304233-0002 | 5/2005 |
| EM | 000412416-0001 | 11/2005 |
| EM | 000490107-0011 | 4/2006 |
| EM | 000806021-0024 | 10/2007 |
| EM | 001169452-0001 | 10/2009 |
| EM | 001990664-0005 | 3/2012 |
| EM | 002140657-0003 | 2/2013 |
| EM | 002422568-0002 | 3/2014 |
| EM | 002708487-0003 | 6/2015 |
| EM | 003024371-0014 | 3/2016 |
| EM | 003008994-0041 | 6/2016 |
| EP | 0508239 | 1/1993 |
| EP | 1586814 | 10/2005 |
| JP | D1318432 | 1/2008 |
| JP | D1362285 | 6/2009 |
| JP | D1400150 | 11/2010 |
| JP | D1446944 | 7/2012 |
| JP | D1512803 | 12/2014 |
| JP | D1530472 | 8/2015 |
| TR | 087684-0004 | 12/2015 |

OTHER PUBLICATIONS

"Pictures of Architectural Downlights, the Multidir Trimless Ceiling Lights", Online Available at : http://sparksdirect.blogspot.com/2011/03/pictures-of-architectural-downlights.html, Mar. 23, 2011, 3 pages.

"Rotatable Aluminum Ceiling Light Recessed 6/12W 4/7*2 Inch LED Light Fixture Recessed in White/Warm for Dining Room", Online Available At: https://m.beautifulhalo.com/4-packrotatable-aluminum-ceiling-light-recessed-612w-472-inch-led-light-fixture-recessed-in-whitewarm-for-dining-room-p-344084.html, Accessed from internet on Apr. 29, 2020, 3 pages.

"The Blade", Online Available at: www.iguzzini.com, 28 pages.

"WAC Lighting MT-5LD445TL-S Tesla Multiple Spots 12 Wide 4-Light Adjustable Invisible Trim with Spot Beam Spread—N/A", Online Available At: https://www.lightingshowplace.com/wac-lighting-mt-5ld445tl-s-tesla-multiple-spots-12-wide-4-light-adjustable-invisible-trim-with-spot-beam-spread/f3218106, Accessed from internet on Apr. 29, 2020, 3 pages.

"Compar Recessed Luminaires—Powerhouse for Linear Aesthetics", ERCO, Available Online at: www.erco.com/compar, Nov. 16, 2017, 5 pages.

"The Black Line", FLOS Architectural, Available Online at: www.flos.com, 2008, 2 pages.

* cited by examiner

ROTATABLE LINEAR DOWNLIGHT

This application claims the benefit of U.S. Provisional Patent Application No. 62/813,980, filed Mar. 5, 2019 and titled "Rotatable Linear Downlight", the entire disclosure of which is hereby incorporated by reference herein for all purposes.

BACKGROUND OF THE INVENTION

FIG. 1 illustrates two luminaires 101 and 102 mounted in a ceiling 103. Luminaires of this type are often used to provide down lighting in residential or commercial spaces. Luminaire 101 is tiltable, so that the light it produces can be directed in a direction other than straight down, for example to illuminate artwork 104 on a wall 105, or for other purposes. Luminaire 102 may be fixed, so that its light is directed generally downward. The downward direction, shown as direction 107, is sometimes called "nadir" in the illumination arts.

In some prior luminaires, providing a tilt such as in luminaire 101 required leaving large gaps 106 at the sides of the luminaire, to provide clearance for the moving parts, to accommodate the rotation mechanism, for actuation access to the moving part of the luminaire, or for other purposes. However, in a fixed luminaire such as luminaire 102, no gaps are needed or provided. When both kinds of luminaires 101 and 102 are installed in the same ceiling, they do not present a unified appearance.

In some luminaires, gaps such as gaps 106 may be avoided, but the luminaires are tiltable in only one direction from nadir 107. If it is desired to redirect the light in another direction, the luminaire must be removed from the ceiling, rotated, and reinstalled—an inconvenient process for the user.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

According to a first aspect, a luminaire comprises a frame defining an opening, the frame having first and second frame edges on opposite sides of the opening. The luminaire also comprises a carriage disposed within the opening, the carriage having a front face and first and second carriage edges on opposite sides of the front face. The luminaire further comprises one or more light sources arranged on the carriage, and a tilting mechanism arranged such that the carriage is tiltable in at least two directions within the opening. The carriage is positionable in a central position such that the first carriage edge is proximate the first frame edge and the second carriage edge is proximate the second frame edge. When the carriage is tilted in a first direction from the central position, the first carriage edge remains proximate the first frame edge, and when the carriage is tilted in a second direction from the central position, the second carriage edge remains proximate the second frame edge.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
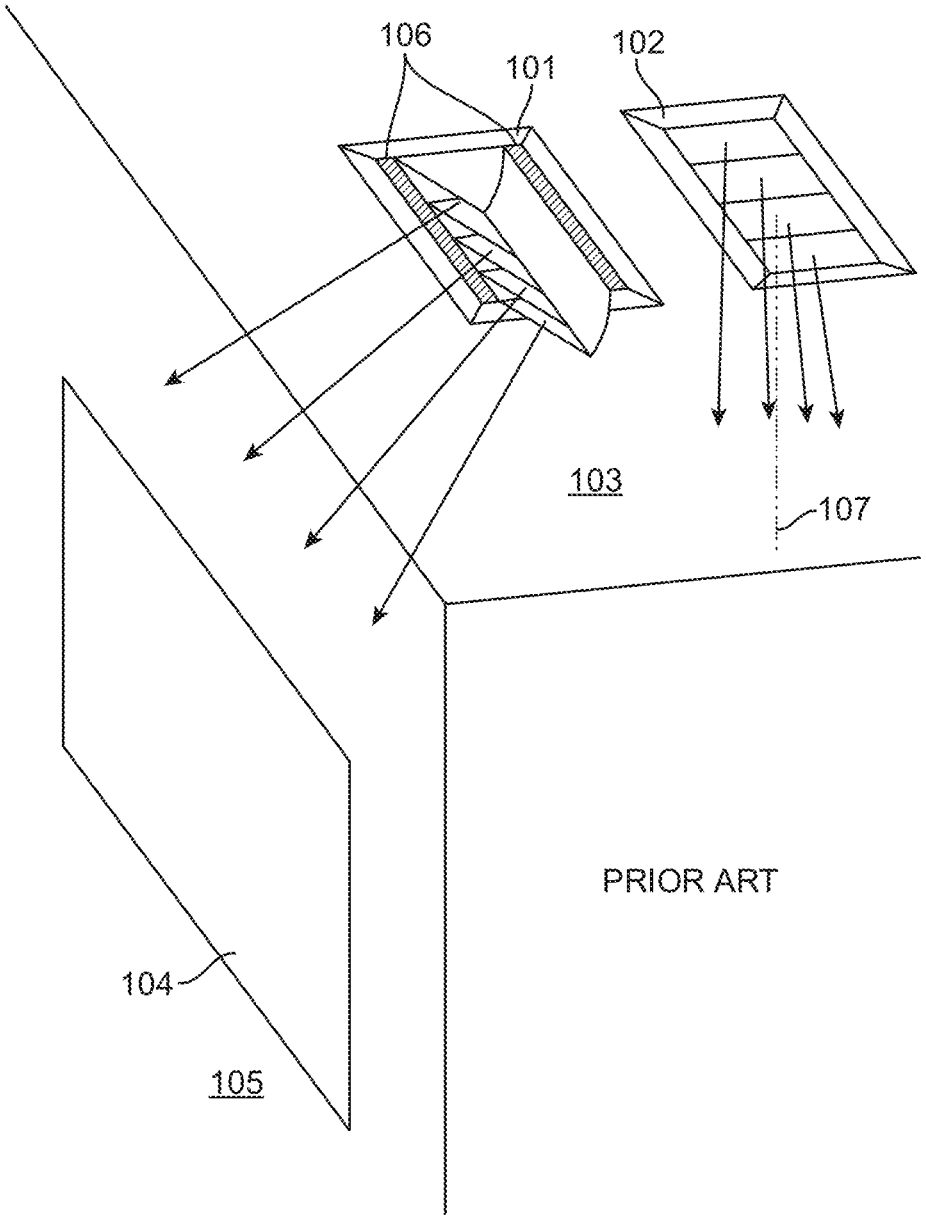
FIG. 1 illustrates two luminaires and mounted in a ceiling.
Figure 2:
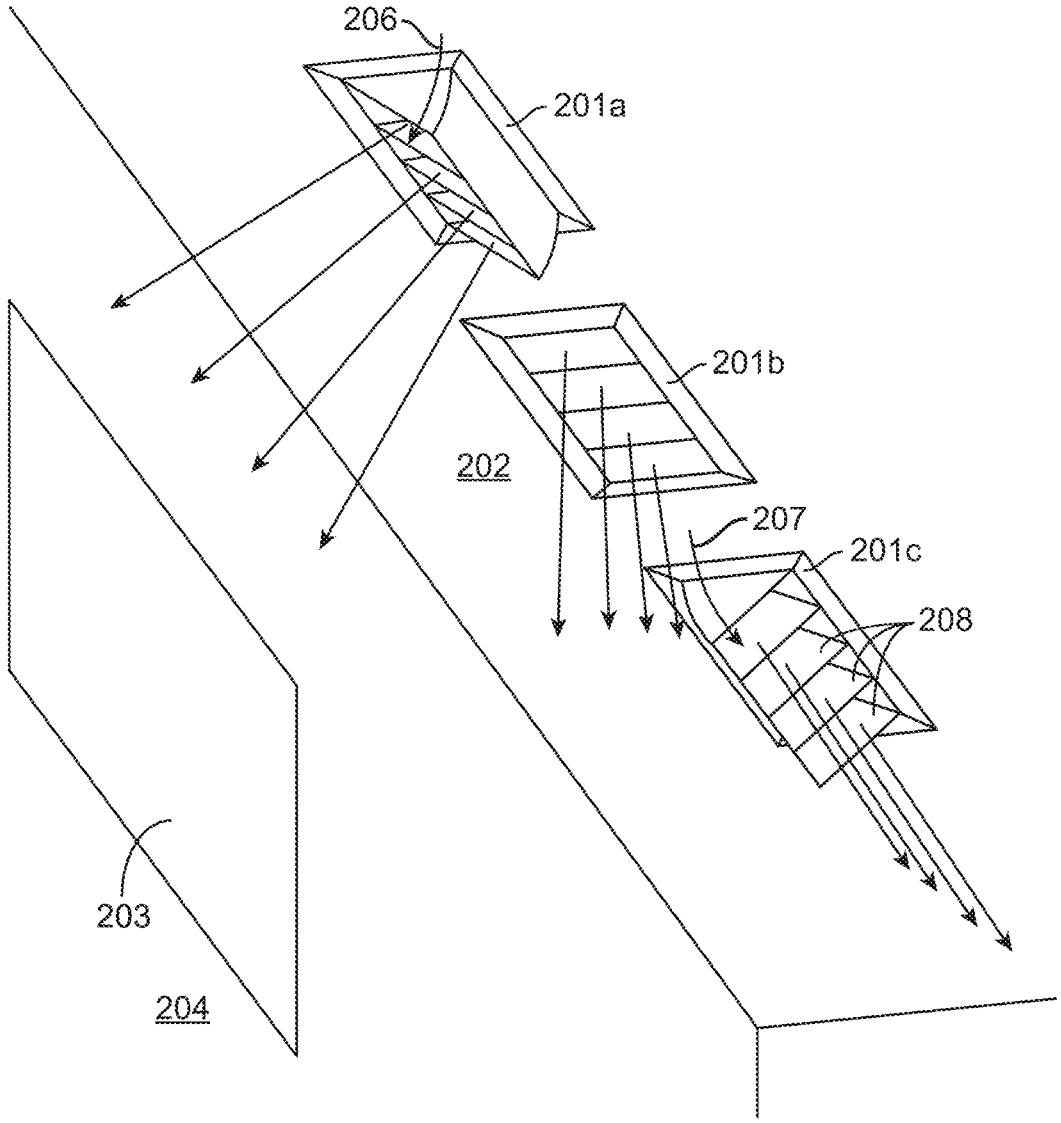
FIG. 2 depicts three identical luminaires in accordance with embodiments of the invention, installed in a ceiling and adjusted differently.

FIG. 2 depicts three identical luminaires 201*a*, 201*b*, and 201*c* in accordance with embodiments of the invention, installed in a ceiling 202 and adjusted differently. The designations 201*a*, 201*b*, and 201*c* are useful to distinguish the different positions of the luminaire, but a luminaire such as luminaires 201*a*, 201*b*, and 201*c* will sometimes be referred to simply as a luminaire 201. Luminaire 201*a* has been configured to direct its light generally toward artwork 203 on wall 204. Luminaire 201*b* has been configured to direct its light downward (toward nadir), and luminaire 201*c* has been configured to direct its light away from wall 204. Each of luminaires 201*a*-201*c* can be reconfigured in place, to redirect its light toward or away from wall 204 or to any configuration in between, without removing it from ceiling 202. For example, part of luminaire 201*a* has been tilted in direction 206 as compared with luminaire 201*b*, and part of luminaire 201*c* has been tilted in direction 207 as compared with luminaire 201*b*. In addition, no gaps are needed at the sides of the moving portions of the luminaires. Thus, an installation of luminaires according to embodiments of the invention present a unified appearance regardless of the tilt direction of each luminaire within the installation. This is enabled via use of a tilting mechanism, an example of which is described in more detail below.

In the example of FIG. 2, each of the luminaires includes one or more compartments 208, each of which includes one or more reflectors and a light source. The light source preferably includes one or more light emitting diodes (LEDs), as is explained in more detail below. In other embodiments, different kinds of light sources may be used.

Figure 3:
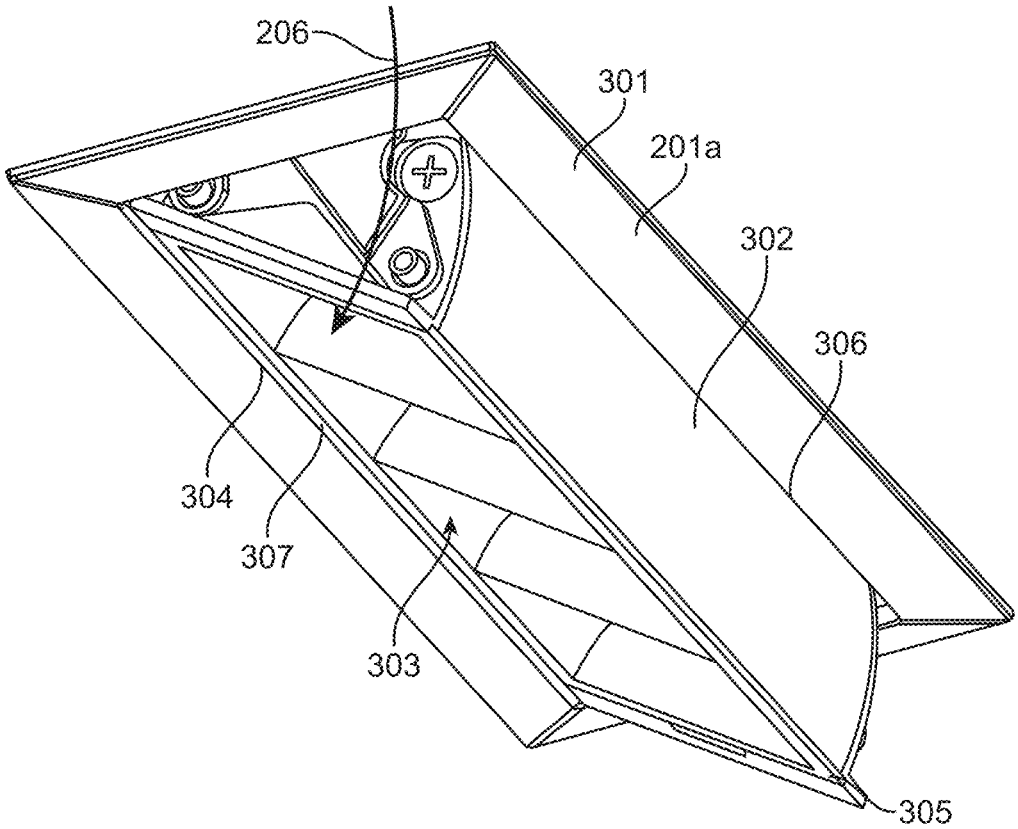
FIG. 3 illustrates one of the luminaires of FIG. 2 in more detail.

FIG. 3 illustrates luminaire 201*a* in more detail. Luminaire 201*a* includes a frame 301 defining an opening in which a tiltable carriage 302 is disposed. Carriage 302 has a front face 303, which has two opposite carriage edges 304 and 305. The opening in frame 301 has two opposite frame edges 306 and 307. As is visible in FIG. 2, when the luminaire is in the configuration of luminaire 201*b*, with its front face 303 aligned with frame 301, carriage edge 304 is positioned proximate frame edge 307, and carriage edge 305 is positioned proximate frame edge 306. That is, front face 303 is essentially "in plane" with frame 301.

However, when the luminaire is placed in the configuration of FIG. 3, by tilting carriage 302 in direction 206, carriage edge 304 remains proximate frame edge 307, while carriage edge 305 moves away from frame 301. Similarly, when the luminaire is placed in the configuration of luminaire 201*c*, by tilting carriage 302 in direction 207, carriage edge 305 remains proximate frame edge 306, and carriage edge 304 moves away from frame edge 307.

It will be appreciated that these effects cannot be achieved with a single-degree-of-freedom rotation of carriage 302 about a fixed longitudinal axis. In a pure rotation, the edges of carriage 302 would necessarily move opposite each other, so it would not be possible to move carriage 302 from its position in luminaire 201*b* to both of the other positions.

Figure 4:
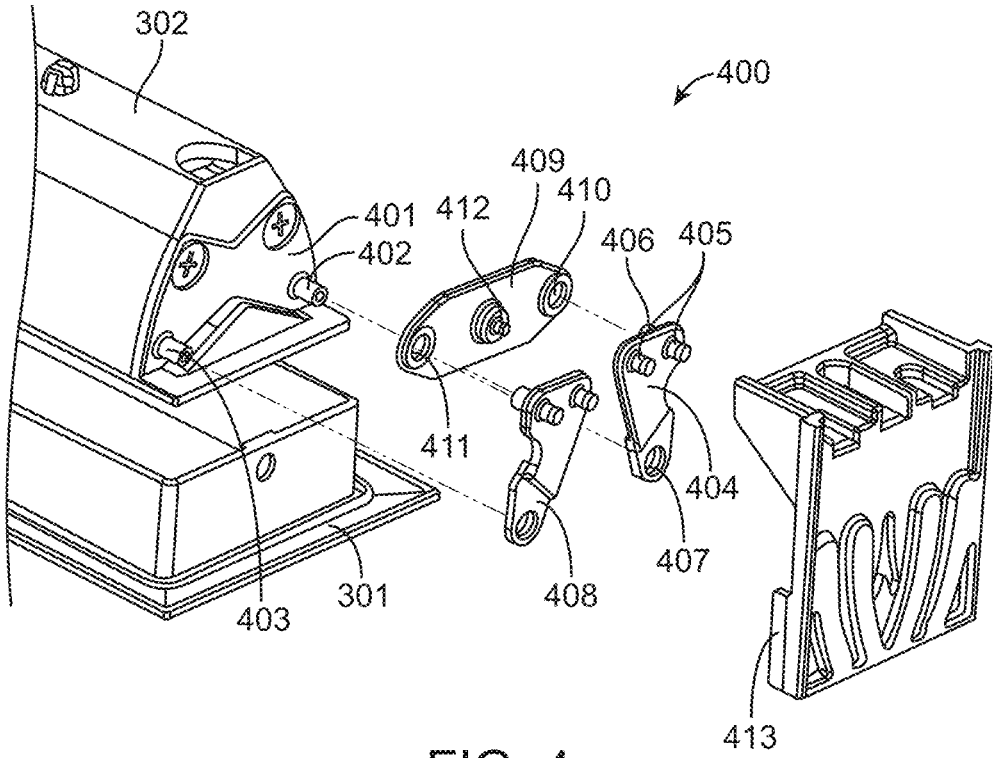
FIG. 4 shows an upper exploded oblique view of a tilt mechanism in accordance with embodiments of the invention.
Figure 5:
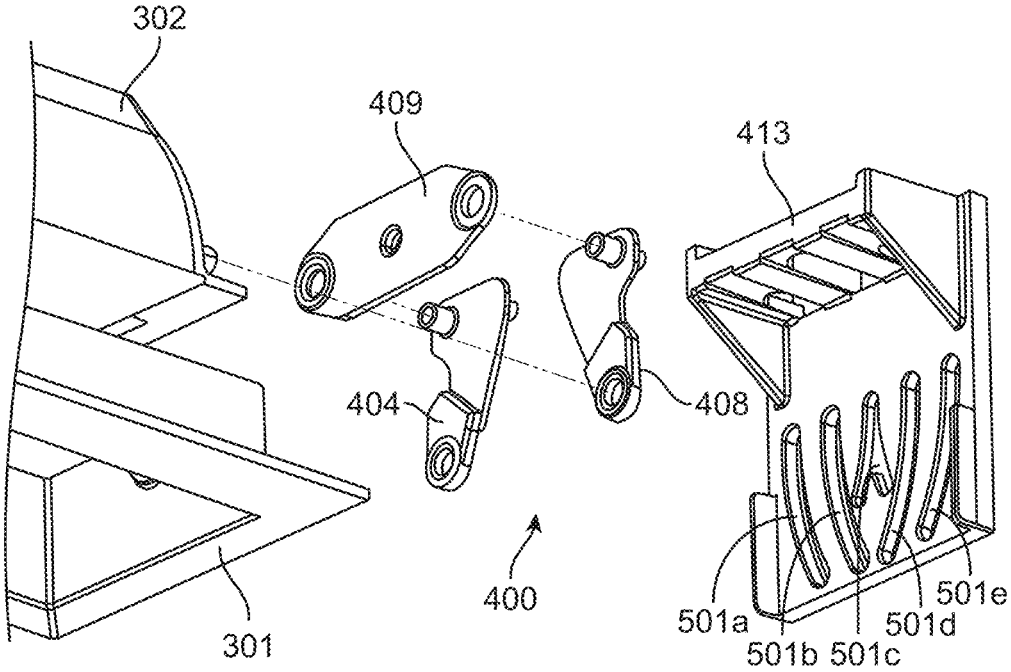
FIG. 5 shows a lower exploded oblique view of a tilt mechanism in accordance with embodiments of the invention.

FIG. 4 and FIG. 5 shows upper and lower exploded oblique views of a tilt mechanism 400 in accordance with embodiments of the invention. Frame 301 is attached to surrounding structure (not shown in FIGS. 4 and 5), and carriage 302 moves within frame 301. An end plate 401 is part of carriage 302, and includes studs 402 and 403. A left link 404 includes two protrusions 405 extending away from carriage 302, and a stud 406 extending toward carriage 302. A hole 407 is sized to receive stud 402 of end plate 401 to form a journal bearing, allowing left link 404 to rotate with respect to end plate 401.

A right link 408 is a mirror image of left link 404, and has the same features in mirror image. Right link 408 is configured to couple with stud 403 of end plate 401.

A center link 409 includes two holes 410 and 411 sized to receive studs 406 of left and right links 404 and 408, forming journal bearings that allow left and right links 404 and 408 to rotate in relation to center link 409. Center link 409 also includes a protrusion 412 extending away from carriage 302.

A guide plate 413 is also fixed to surrounding structure and includes a number of cam grooves, specifically left curved cam grooves 501*a*, 501*b*, central Y-shaped cam groove 501*c*, and right curved cam grooves 501*d* and 501*e*. Protrusions 405 of left link 404 engage left curved cam grooves 501*a* and 501*b*, protrusions 405 of right link 408 engage right curved cam grooves 501*d* and 501*e*, and protrusion 412 of center link 409 engages central Y-shaped cam groove 501*c*. The combination of the links, protrusions, and cam grooves constrains the motion of carriage 302 to enable the positions shown in FIG. 2. Each of cam grooves 501*a*-501*e* may be partially enclosed, or may form an opening through end plate 401.

Figure 8:
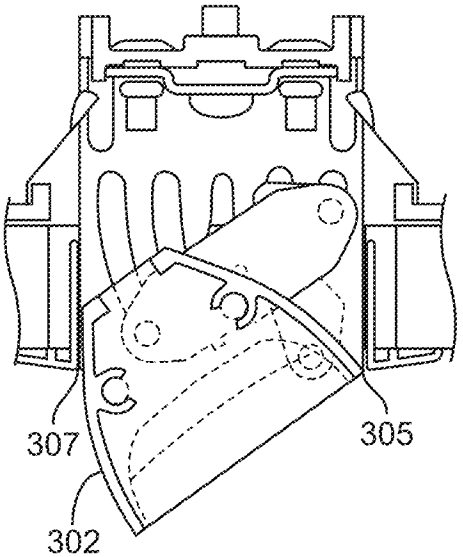
FIGS. 6-8 illustrate the motion of the tilt mechanism of FIGS. 4 and 5, in accordance with embodiments of the invention.
Figure 7:
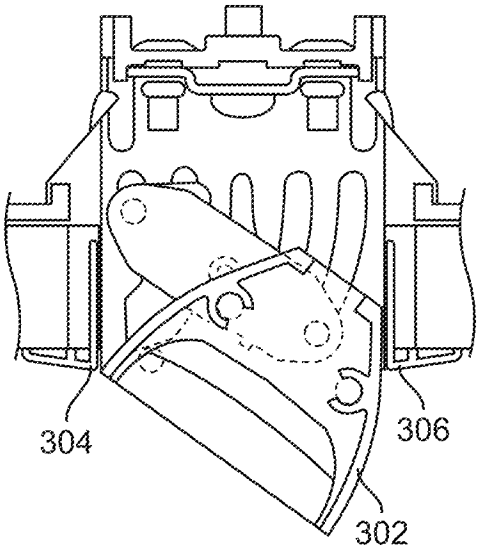
Figure 6:
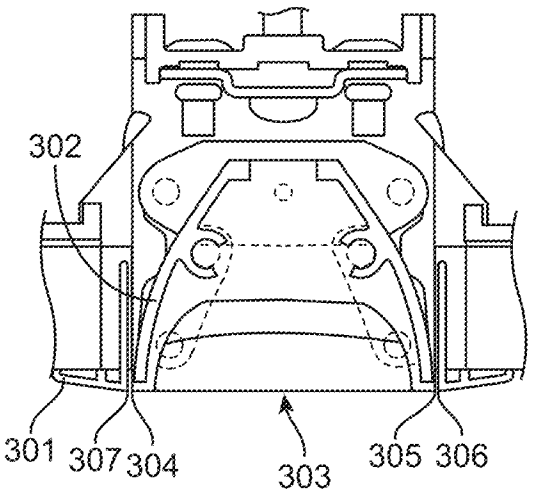

FIGS. 6-8 illustrate the motion of carriage 302 in more detail.

In FIG. 6, carriage 302 is in the position of luminaire 201*b*, shown in FIG. 2. In this position, front face 303 of carriage 302 is essentially in plane with the opening in frame 301. Notably, no appreciable gap is needed where carriage edge 304 meets frame edge 307, or where carriage edge 305 meets frame edge 306. This is not to suggest that carriage 302 necessarily touches frame 301. A small clearance, for example up to about 2 millimeters, may be provided to permit motion and to allow for fabrication and assembly tolerances. But as compared with prior designs, the gap is visually insignificant.

In FIG. 7, carriage 302 has been moved to the position of luminaire 201*a*, shown in FIG. 2. During the transition from the position of FIG. 6, left, right, and center links 404, 408, and 409 have followed cam grooves 501. The links and grooves are configured such that the carriage 302 appears to rotate about a "virtual" pivot point at carriage edge 304. In addition, carriage 302 is shaped so that the side opposite the virtual pivot point remains close to frame edge 306 during the motion, so that no appreciable gap is created between carriage 302 and frame edge 306 at any point during the motion. Preferably, the sides of carriage 302 are curved in such a way that the side opposite the virtual pivot point maintains a substantially constant spacing to the frame during the rotation.

In FIG. 8, carriage 302 has been moved to the position of luminaire 201*c*, shown in FIG. 2. In this example, the transition from the position of FIG. 6 to the position of FIG. 8 is merely the mirror image of the transition from the position of FIG. 6 to the position of FIG. 8. In FIG. 8, the virtual pivot point is near carriage edge 305, and no gap is formed between carriage 302 and frame edge 307. While the parts in the example shown are symmetrical, this is not a requirement, and asymmetrical embodiments are possible.

Figure 9:
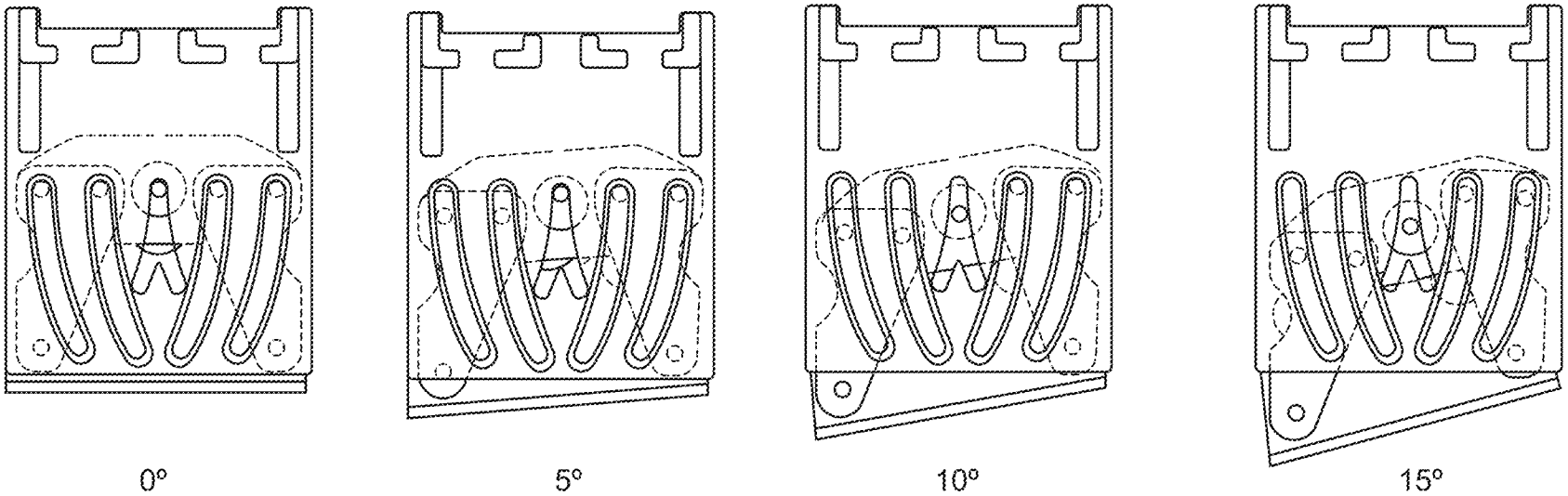
FIG. 9 shows the transition of the tilt mechanism of FIGS. 4 and 5 from the position of FIG. 6 to the position of FIG. 7, in 5-degree increments.
Figure 9:
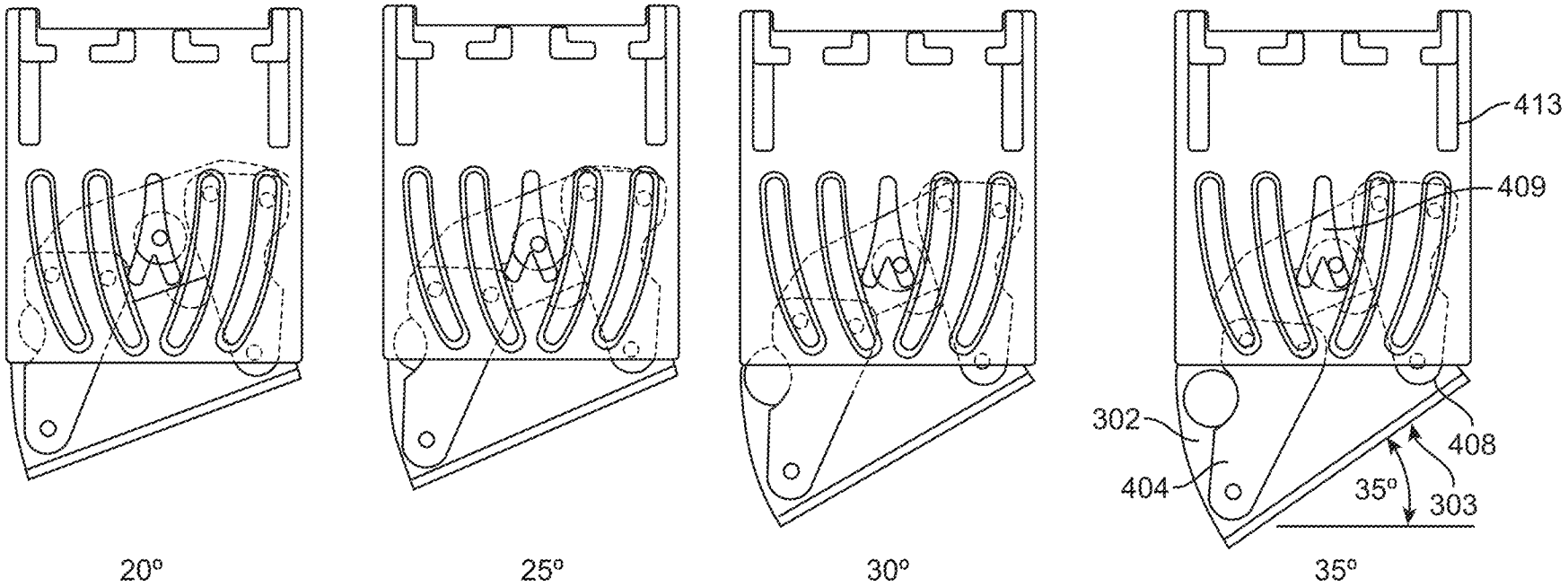

FIG. 9 shows the transition of carriage 302 from the position of FIG. 6 to the position of FIG. 8 in 5-degree increments, as measured by the angle of face 303 to horizontal. The motions of carriage 302 and left, right, and center links 404, 408, and 409 in relation to guide plate 413 are apparent.

Figure 10:
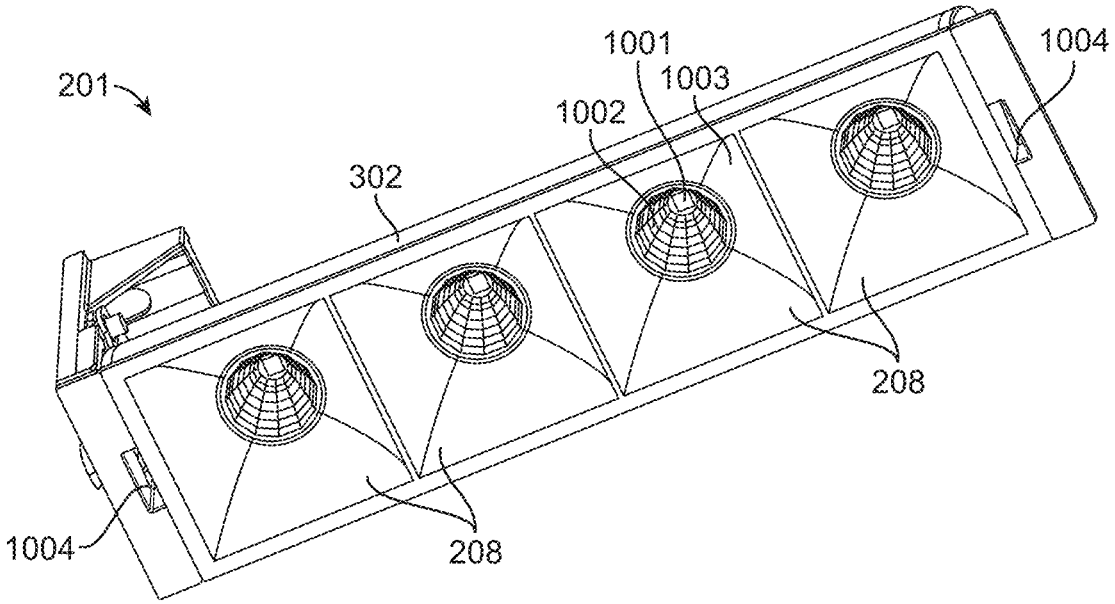
FIG. 10 shows a lower oblique view of a portion of a luminaire, showing additional details in accordance with embodiments of the invention.

FIG. 10 shows a lower oblique view of a portion of luminaire 201*b*, showing additional details in accordance with embodiments of the invention. It should be understood, however, that embodiments of the tilt mechanism disclosed herein are not limited for use with the illustrated luminaires; rather, the tilt mechanism could be incorporated for use with luminaires having any of many different geometries. Illustrated luminaire 201*b* includes four compartments 208 within carriage 302. However, luminaire 201*b* could have any number of compartments 208. Each compartment 208 houses an LED 1001, a reflector 1002, and a shroud 1003. Each reflector 1002 may at least partially collimate the light emanating from its respective LED 1001. In some embodiments, the reflector is segmented, but this is not a requirement. Tooling slots 1004 may be provided for actuating the tilt mechanism.

Figure 11:
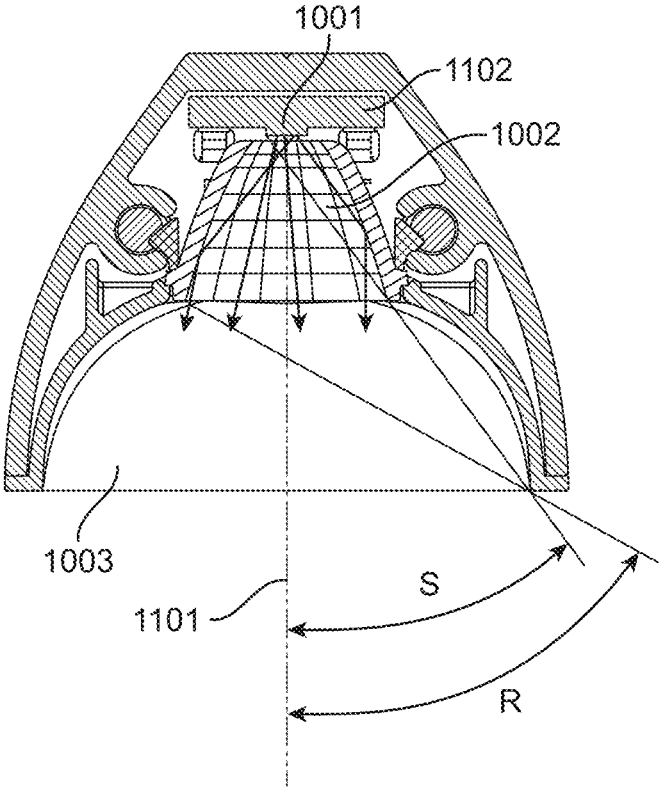
FIG. 11 is a cross section of a portion of a luminaire, in accordance with embodiments of the invention.

FIG. 11 is a cross section of one of compartments 208, illustrating the relationships of LED 1001, segmented reflector 1002, and shroud 1003. A handful of light rays emanating from LED 1001 are shown to illustrate the operation of reflector 1002. Shroud 1003 may but need not participate in directing rays from LED 1001. In some embodiments, shroud 1003 may be entirely decorative. However, shroud 1003 serves to limit the reflection angle R and source angle S. Source angle S defines a cone about axis 1101 within which an observer can directly see LED 1001. It is desirable that source angle S be small, so that potentially-distracting bright spots in the observer's field of view be minimized. Reflection angle R defines a cone about axis 1101 within which an observer can directly see reflector 1002. While a direct view of reflector 1002 may not be as distracting as a direct view of LED 1001, it is still desirable that reflection angle R also be small. In the example shown, reflection angle R is about 61 degrees, and source angle S is about 37 degrees, although these angles may be different in other embodiments. For example, source angle S may be between 20 and 70 degrees, and reflection angle R may be between 25 and 80 degrees. Preferably the source angle S is between 30 and 45 degrees, and the reflection angle R is between 50 and 70 degrees.

In other embodiments, either or both of reflector 1002 and shroud 1003 may be omitted, so that LEDs 1001 may be visible from nearly any angle. In some embodiments, a diffuser may be positioned in front of LEDs 1001.

LEDs 1001 are preferably mounted to a printed circuit board 1102 through which LEDs 1001 are supplied with power. A heat sink (not shown) may also be provided to conduct heat away from LEDs 1001.

Figure 12:
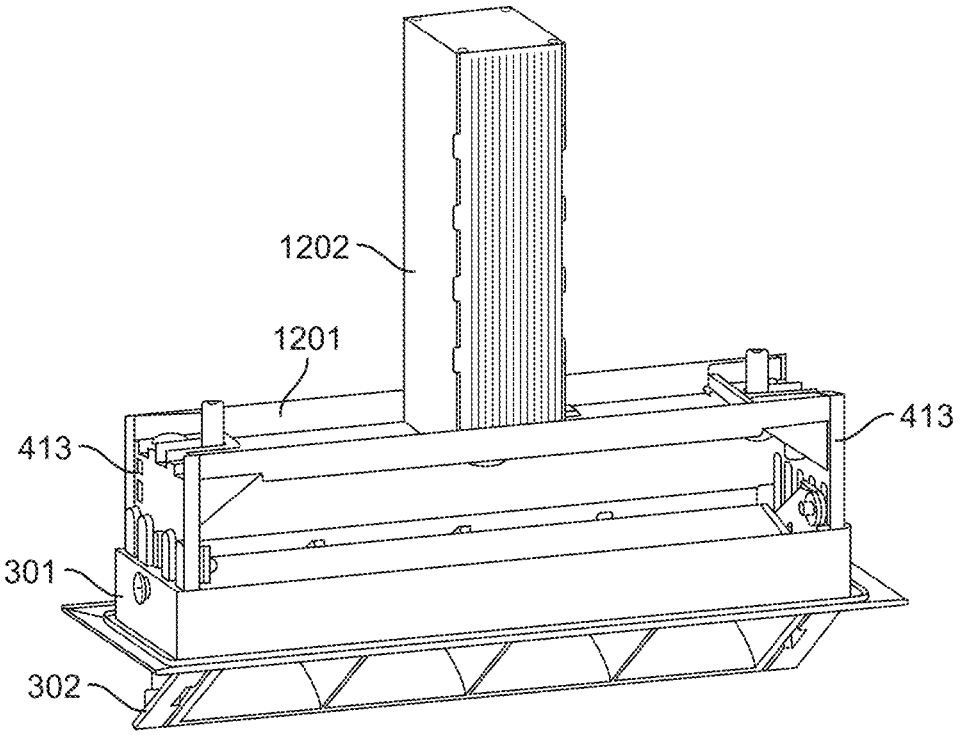
FIG. 12 illustrates additional details a luminaire, in accordance with embodiments of the invention.

FIG. 12 illustrates additional details of luminaire 201, in accordance with embodiments of the invention. In this example, guide plates 413 are joined with frame 301 and a channel 1201 to form a structure for supporting carriage 302. A driver 1202 is attached to channel 1201. Driver 1202 may convert line voltage, for example 110 volt or 220 volt alternating current (AC) power to a lower voltage direct current (DC) power suitable for driving LEDs 1001. (Wiring to driver 1202 and from driver 1202 to LEDs 1001 is not shown.)

Figure 13:
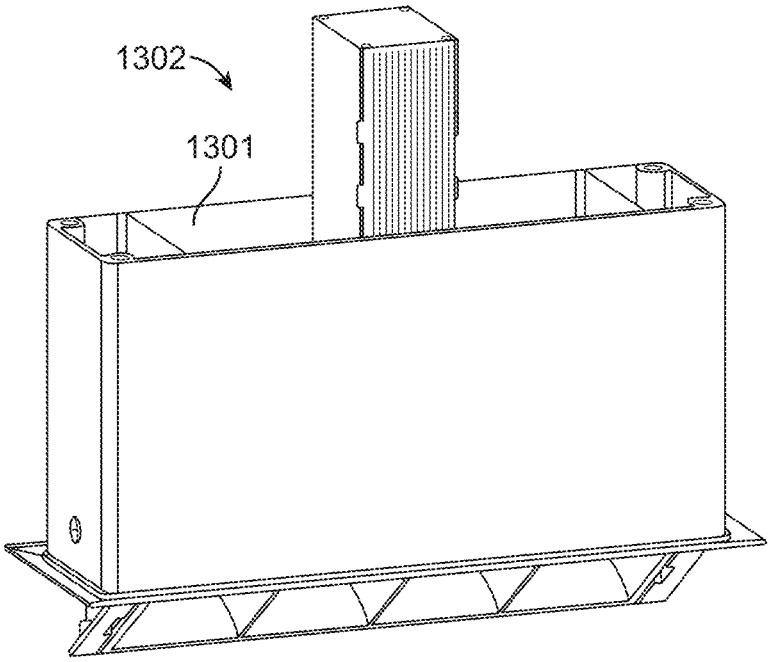
FIG. 13 illustrates additional details of a luminaire, in accordance with embodiments of the invention.

FIG. 13 illustrates an additional sleeve 1301 attached to the assembly of FIG. 12, to form a module 1302 in accordance with embodiments of the invention. Sleeve 1301 preferably has straight vertical sides, for reasons explained below.

Figure 14:
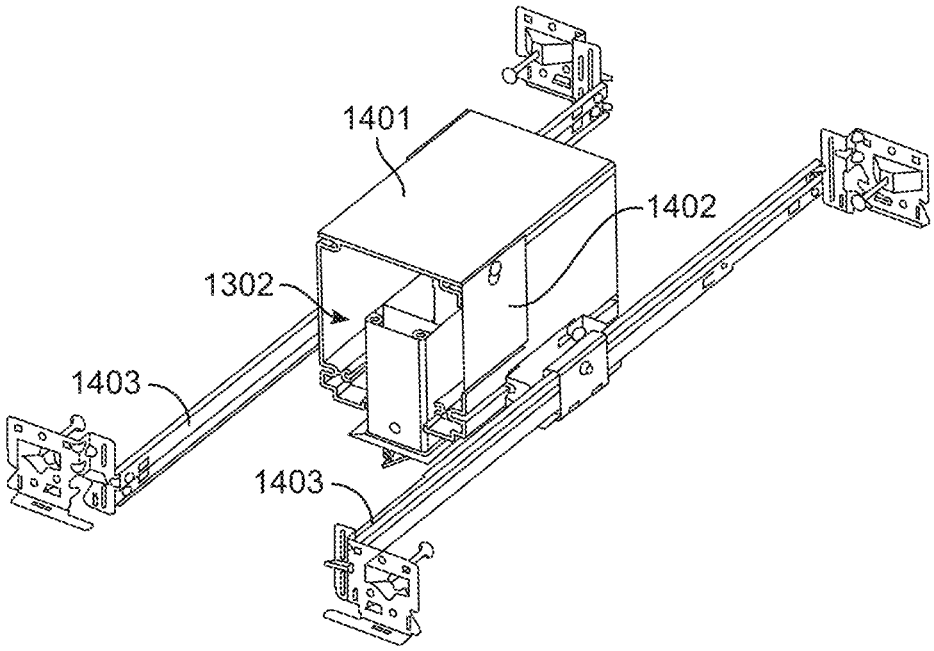
FIG. 14 shows a module of a luminaire installed in a housing, in accordance with embodiments of the invention.

FIG. 14 shows module 1302 installed in a housing 1401, in accordance with embodiments of the invention. An end plate of housing 1401 has been omitted from FIG. 14, for clarity of illustration. In actual use, housing 1401 is preferably fully enclosed to comply with electrical codes. Housing 1401 may be an extruded housing as shown, or may be formed in another way. For example, housing 1401 may be a sheet metal housing, or made of another material or materials by any suitable process. Removable access panels 1402 may be provided for making electrical connections from outside housing 1401 to module 1302 inside housing 1401.

Optionally, adjustable brackets 1403 may be affixed to housing 1401, permitting housing 1401 to be mounted between ceiling joists or the like. However, other mounting schemes may be used.

Figure 15:
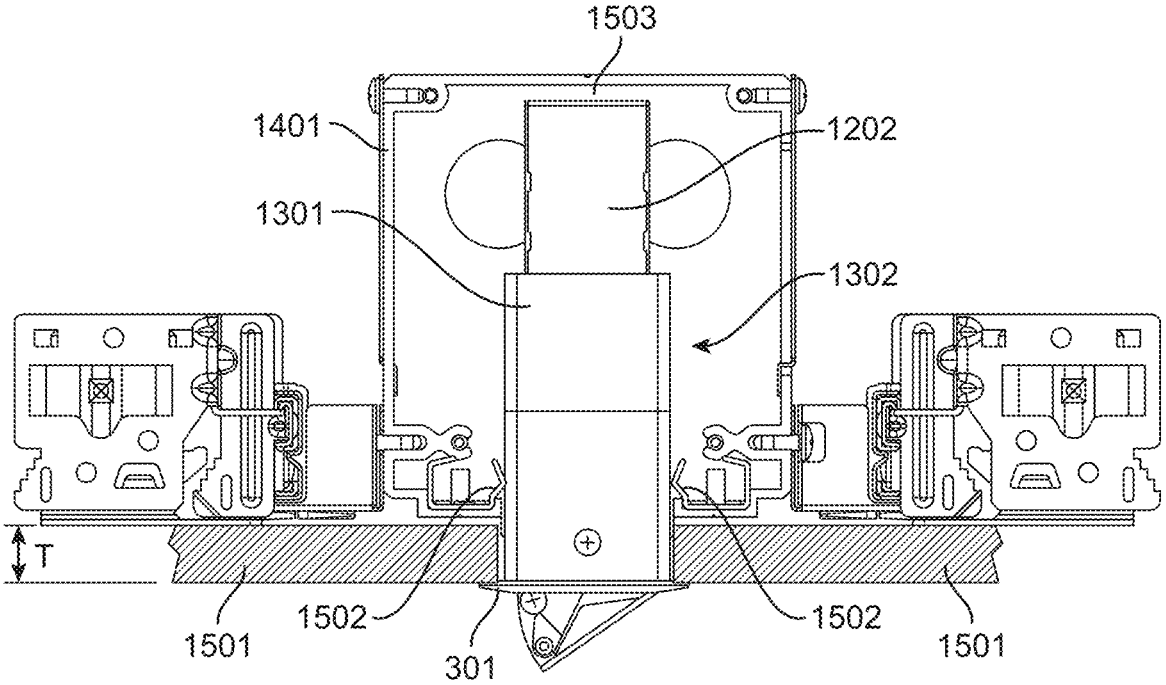
FIG. 15 illustrates additional details of the installation of the module of FIG. 14, in accordance with embodiments of the invention.

FIG. 15 illustrates additional details of the installation of module 1302, in accordance with embodiments of the invention. In the example of FIG. 15, housing 1401 has been mounted above a ceiling 1501 made up of panels having a thickness T. Module 1302 has been slid upward through an opening in ceiling 1501 until frame 301 contacts the bottom of ceiling 1501. Friction springs 1502 mounted to housing 1401 contact the sides of sleeve 1301, and suspend module 1302 within housing 1401 by the force of friction. Friction springs 1502 may include sharp edges, barbs, or other features for enhancing the friction between friction springs 1502 and sleeve 1301. However, it is preferably possible to overcome the friction of friction springs 1502 by pulling firmly down on frame 301 or another part of module 1302, so that module 1302 can be serviced or replaced from below ceiling 1501.

The arrangement of FIG. 15 can accommodate a wide range of ceiling panel thicknesses T, by providing clearance 1503 above driver 1202 (to accommodate thin ceiling panels without hitting the top of housing 1401), and by the height of sleeve 1301 (to accommodate thick ceiling panels while still engaging friction springs 1502).

Figure 16:
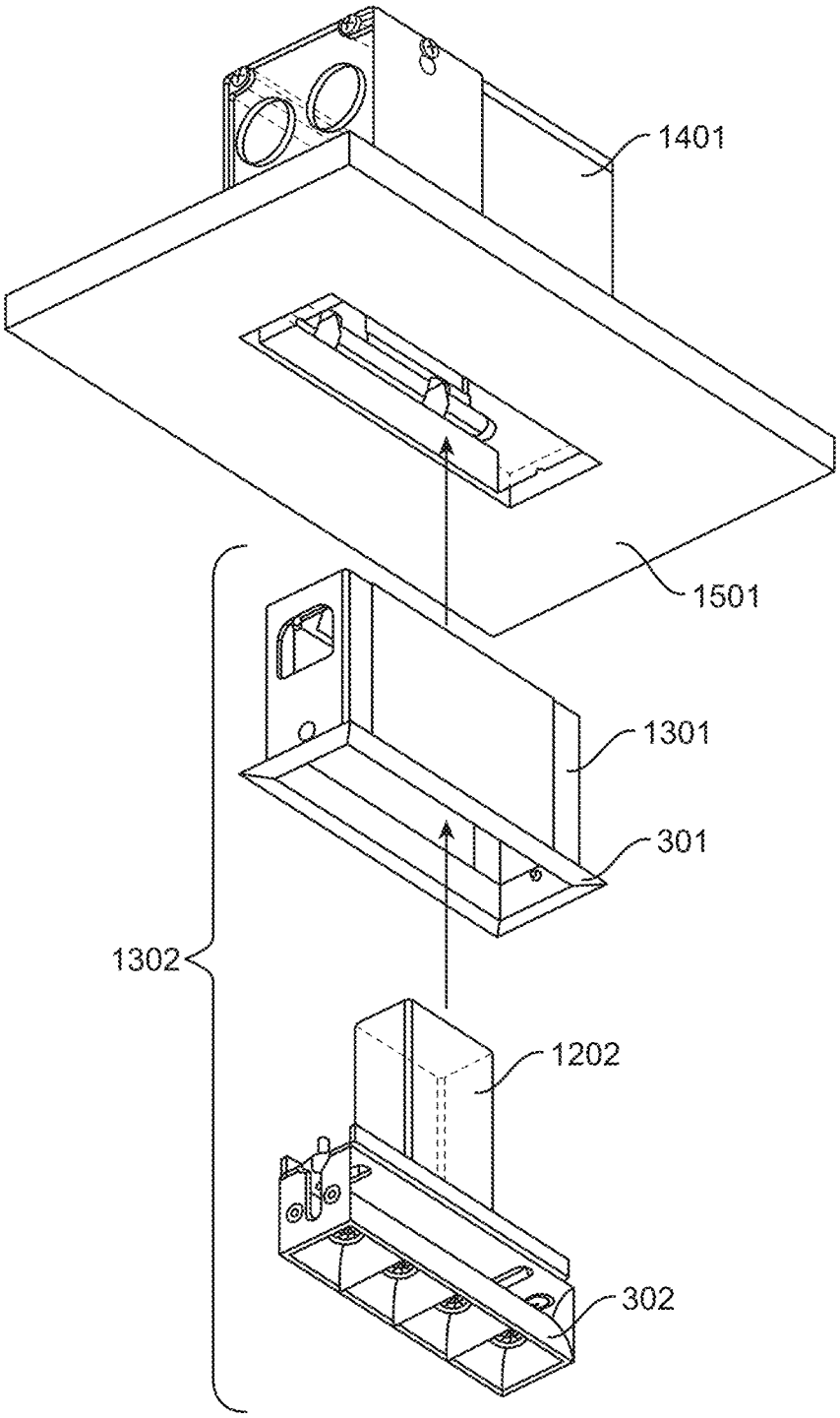
FIG. 16 is a lower oblique view, showing the installation of the module of FIG. 14 into the housing from below a ceiling, in accordance with embodiments of the invention.

FIG. 16 is a lower oblique view, showing the installation of module 1302 into housing 1401 from below ceiling 1501, in accordance with embodiments of the invention.

Figure 17:
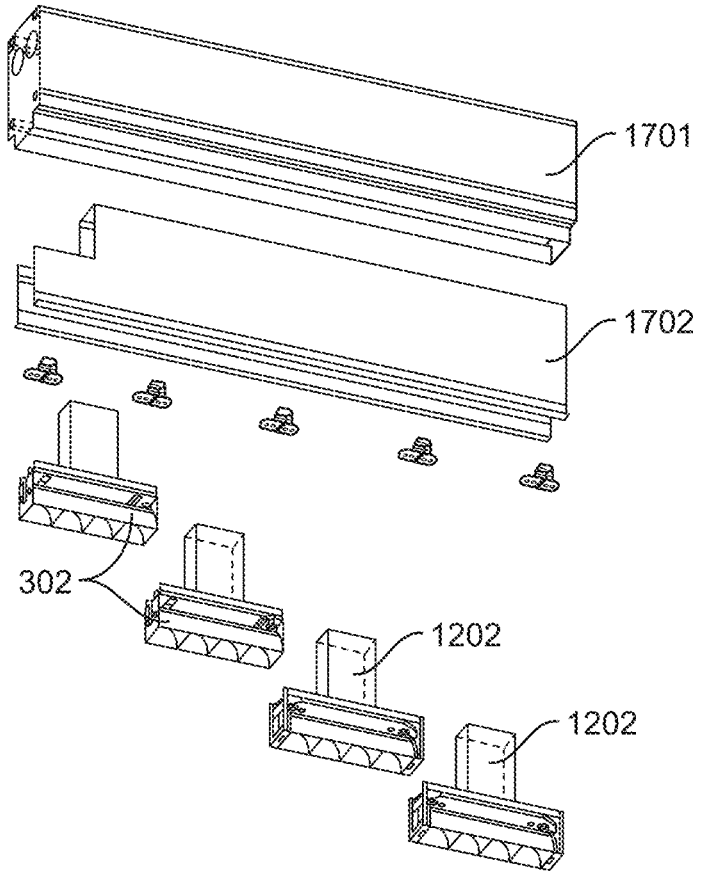
FIG. 17 illustrates an elongated housing, into which multiple lighting modules can be installed, in accordance with embodiments of the invention.

While the above embodiments house a single module 1302 in housing 1401, other embodiments may provide for housing multiple modules. For example, FIG. 17 illustrates an elongated housing 1701 and an elongated sleeve 1702, into which multiple carriages 302, drivers 1202, and tilt mechanisms can be installed.

Figure 18:
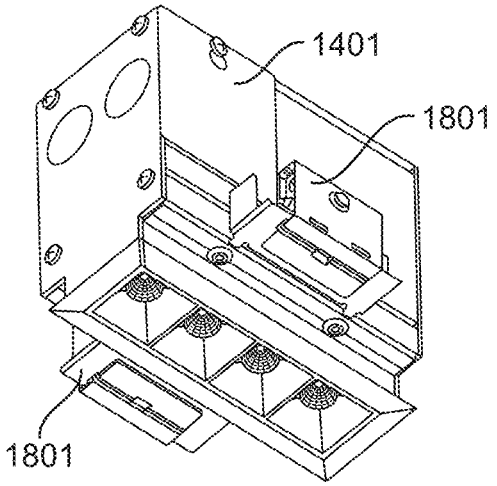
FIG. 18 illustrates brackets mounted to sides of a housing, in accordance with embodiments of the invention.
Figure 19:
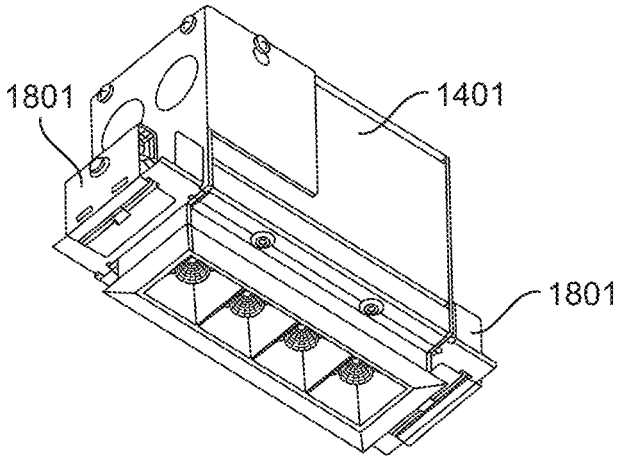
FIG. 19 illustrates brackets mounted to ends of a housing, in accordance with embodiments of the invention.

As was discussed above in relation to FIG. 14, adjustable brackets 1403 are but one possible way of mounting a housing in accordance with embodiments of the invention. Any other suitable brackets or other mounting features may be used. For example, as shown in FIG. 18 and FIG. 19, mounting brackets 1801 may be mounted to either the sides of housing 1401 (as shown in FIG. 18) or to the ends of housing 1401 (as shown in FIG. 19), to provide additional mounting flexibility.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A luminaire, comprising:

a frame defining an opening, the frame having first and second frame edges on opposite sides of the opening;

a carriage disposed within the opening, the carriage having a front face and first and second carriage edges on opposite sides of the front face;

one or more light sources arranged on the carriage; and a tilting mechanism arranged such that the carriage is tiltable in at least two directions within the opening, wherein:

the carriage is positionable in a central position such that the first carriage edge is proximate the first frame edge and the second carriage edge is proximate the second frame edge;

when the carriage is tilted in a first direction from the central position, the first carriage edge remains proximate and parallel to the first frame edge, such that the carriage appears to rotate about the first carriage edge or the first frame edge; and when the carriage is tilted in a second direction from the central position, the second carriage edge remains proximate and parallel to the second frame edge, such that the carriage appears to rotate about the second carriage edge or the second frame edge.

2. The luminaire of claim 1, wherein the carriage comprises a first carriage side adjacent the first carriage edge and a second carriage side adjacent the second carriage edge, and wherein the first and second carriage sides are curved such that:

when the carriage is tilted in the first direction from the central position, the second carriage side maintains a substantially constant spacing from the second frame edge; and when the carriage is tilted in the second direction from the central position, the first carriage side maintains a substantially constant spacing from the first frame edge.

3. The luminaire of claim 1, wherein the tilting mechanism comprises:

a fixed guide plate comprising a plurality of cam grooves; and a linkage coupled to the carriage, the linkage having a plurality of rotatably-coupled links having a plurality of protrusions configured to slide within the cam grooves to constrain motion of the carriage.

4. The luminaire of claim 1, wherein the carriage comprises an end cap having first and second protrusions, and the tilting mechanism comprises:

a fixed guide plate comprising a plurality of cam grooves;

a first side link rotationally coupled to the first protrusion of the end cap, the first side link having two protrusions configured to slide within a first pair of the cam grooves in the guide plate;

a second side link rotationally coupled to the second protrusion of the end cap, the second side link having two protrusions configured to slide within a second pair of the cam grooves in the guide plate; and a center link that rotationally couples to both the first side link and the second side link, wherein the center link includes a protrusion configured to slide within a central cam groove in the guide plate.

5. The luminaire of claim 1, wherein the tilt mechanism enables the carriage to tilt by at least 30 degrees in each of the first and second directions with respect to the frame.

6. The luminaire of claim 1, wherein the one or more light sources comprise a plurality of light emitting diode (LED) light sources arranged linearly.

7. The luminaire of claim 6, further comprising:

a plurality of reflectors, one reflector respectively for each of the plurality of light sources, wherein each of the reflectors at least partially collimates light emanating from its respective light source; and a plurality of shrouds, one shroud respectively for each of the plurality of reflectors;

wherein for each of the plurality of light sources, the respective reflector and shroud cooperate to limit a source angle and a reflection angle of the light source, wherein the source angle is an angle with respect to an optical axis of the reflector beyond which the light source is not directly visible, and wherein the reflection angle is an angle with respect to the optical axis of the reflector beyond which the reflector is not directly visible.

8. The luminaire of claim 7, wherein the source angle is between 30 and 45 degrees.

9. The luminaire of claim 7, wherein the reflection angle is between 50 and 70 degrees.

10. The luminaire of claim 6, further comprising a printed circuit board on which at least two of the plurality of light sources are mounted.

11. The luminaire of claim 1, further comprising at least one tooling slot in the front face of the carriage, providing access for actuation of the tilt mechanism.

12. The luminaire of claim 1, wherein the tilting mechanism comprises two fixed guide plates, one fixed guide plate at each end of the carriage, each guide plate comprising a plurality of cam grooves, and the luminaire further comprises a structural member joining the two fixed guide plates to form a structure that supports the carriage.

13. The luminaire of claim 12, further comprising a driver attached to the structural member, the driver configured to provide power to the light sources.

14. The luminaire of claim 13, further comprising a sleeve surrounding the structure that supports the carriage.

15. The luminaire of claim 14, wherein the carriage, the structure that supports the carriage, the driver, and the sleeve are comprised in a module, the luminaire further comprising:

a housing having an opening of a size and shape to receive the sleeve; and a plurality of friction springs coupled to the housing and positioned to contact sides of the sleeve as the sleeve is received into the housing, the friction springs contacting the sleeve with sufficient force to support the module by frictional force.

16. The luminaire of claim 15, wherein the module is a first module and the luminaire further comprises a second module like the first module, and wherein the opening in the housing is sufficiently large to accommodate at least the first and second modules, and wherein the plurality of friction springs includes friction springs that contact and support the second module.

17. The luminaire of claim 15, further comprising one or more adjustable brackets attached to the housing, configured for mounting the luminaire between ceiling joists.

* * * * *